United States Patent [19]

Igarashi

[11] Patent Number: 4,961,659

[45] Date of Patent: Oct. 9, 1990

[54] PRINTER CASE

[75] Inventor: Hitoshi Igarashi, Suwa, Japan

[73] Assignee: Seiko Epson Corporation, Tokyo, Japan

[21] Appl. No.: 301,071

[22] Filed: Jan. 24, 1989

[30] Foreign Application Priority Data

Jan. 26, 1988 [JP] Japan ..... 63-14821
Jan. 26, 1988 [JP] Japan ..... 63-14829

[51] Int. Cl.[5] ..... B41J 29/02

[52] U.S. Cl. ..... 400/693; 400/603.1; 400/578; 400/647.1

[58] Field of Search ..... 400/693, 690.1–690.4, 400/691, 692, 690, 603, 603.1, 605, 616, 616.1, 616.2, 616.3, 578, 642, 647, 647.1

[56] References Cited

U.S. PATENT DOCUMENTS 4,806,035 2/1989 Maeda ..... 400/647.1
4,815,876 3/1989 Kobayashi et al. ..... 400/603.1
4,826,335 5/1989 Kimura ..... 400/605
4,848,941 7/1989 Imaseki ..... 400/616.1 X

*Primary Examiner*—Edgar S. Burr
*Assistant Examiner*—Motilal P. Patel

[57] ABSTRACT

A printer case adaptable to print individual sheets of paper and fan-fold computer paper has a bottom case and a cover pivotably supported on the cover. The printer components are supported within the bottom case and a sheet guide is pivotably supported on the cover. The sheet guide pivots between a first position for guiding individual sheets into the printer and a second position for guiding fan-fold paper out of the printer once printing has occurred. A coupling structure is provided for pivotably coupling the cover to the bottom so that the cover may pivot between a first position in which the cover is closed to permit printing to occur and a second position in which the cover is open to expose the printer components and permit insertion of fan-fold paper.

17 Claims, 7 Drawing Sheets

FIG. 1
PRIOR ART
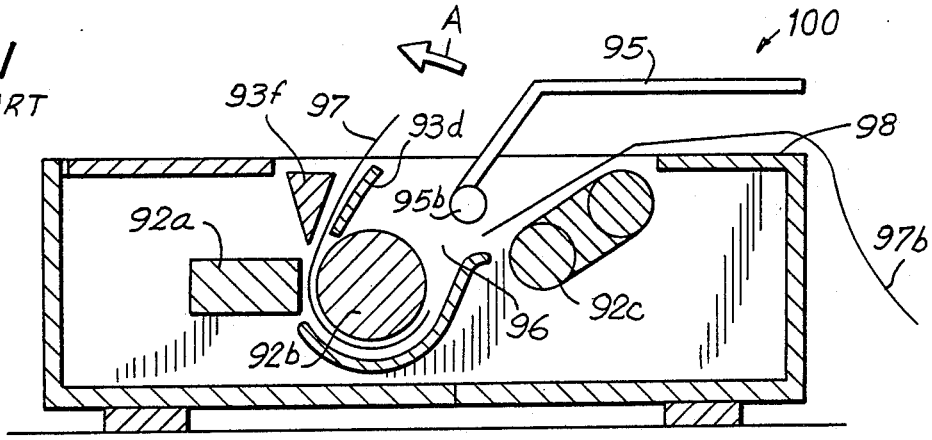
FIG. 2
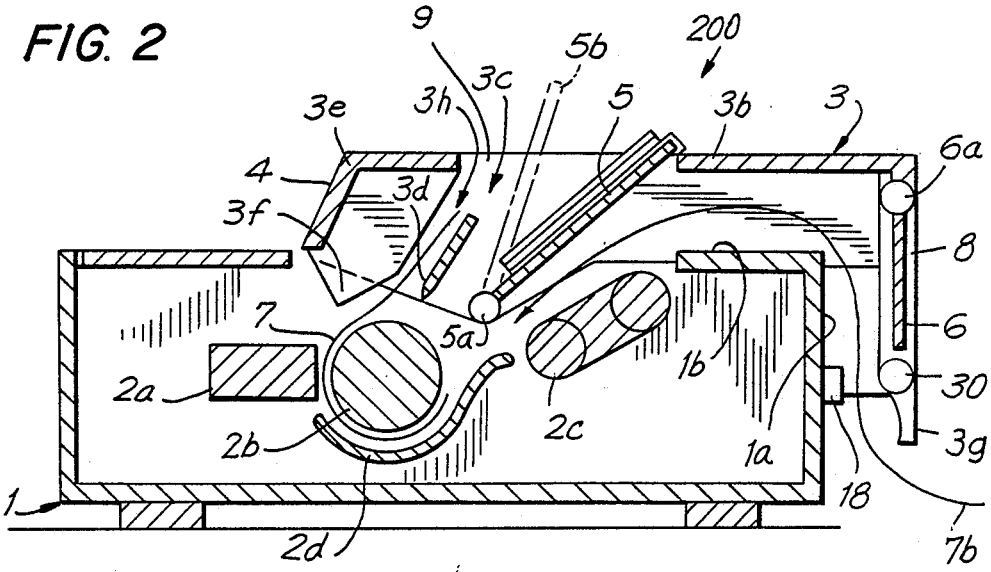
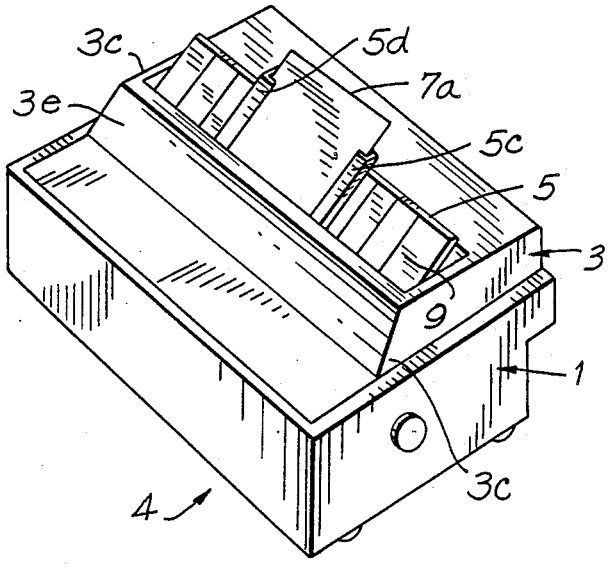
FIG. 3

PRINTER CASE

BACKGROUND OF THE INVENTION

The present invention relates generally to a case for a printer capable of using both individual sheets and fan fold paper and, in particular, to a printer case having an upper cover structure including a paper guide member which is pivotably coupled to the printer in which the upper cover can be opened or closed relative to the printer to permit ready and easy paper insertion.

Printer cases which may be utilized with both fan fold computer paper and individual cut sheets of paper are well known in the art. A printer, generally indicated at 100 having a conventional printer case 98 is shown in FIG. 1. Printer 100 includes a platen **92*b* rotatably supported within printer case 98. A paper push tractor 92*c* for feeding fan fold paper 97*b* is provided upstream of platen 92*b*. A print head 92*a* is disposed adjacent platen 92*b* and spaced a predetermined distance from platen 92*b* to allow cut sheet paper 97 or fan fold paper 97*b* to pass therebetween. Paper ejection guide members 93*f* and 93*d* for guiding paper 97 or 97*b* ejected from printer 92*a* are provided upstream from platen 92*b*. A slit 96 is provided adjacent platen 92*b* to allow cut sheet paper 97 to travel around platen 92*b*. A paper separator 95 is pivotably mounted on printer case 98 about a bearing 95*b* proximate slit 96 to permit printer 100 to accept both cut sheet paper 97 and fan fold paper 97*b*. When separator 95 is positioned as depicted in FIG. 1, printer 100 will accept fan fold paper. When separator 95 is pivoted in the direction of arrow A, printer 100** will accept individual sheets of paper.

In such prior art devices, when preparing printer case 98 to receive fan fold paper, separator 95 covering push tractor **92*c* must be initially pivoted in the direction of arrow A or separator 95 must be removed from the printer to permit the perforation on the edges of the paper to be positioned on the tractors. This procedure is inefficient, cumbersome and time consuming. Additionally, when paper becomes jammed within printer case 98 or components such as a print head or ink ribbon needs to be checked for maintenance, paper ejection guide members 93*f* and 93*d*** must be removed each time such maintenance or servicing occurs. Additionally, the paper separator provided at the outside of the printer case must also be removed.

Accordingly, it is desirable to provide a printer case for a printer to overcome the shortcomings of the prior devices described above.

SUMMARY OF THE INVENTION

Generally speaking, in accordance with the present invention, a printer case for a printer adapted to accept both cut sheets and fan fold computer paper includes a lower case for supporting the printer components having a cover which includes a sheet guide pivotably supported thereon. A coupling mechanism joins the cover to the lower case such that the cover can be pivoted between closed and open positions. Friction is created when the cover is rotated in a direction that closes the cover against the lower case. The sheet guide is rotatably supported within the cover and is rotatable between a first position and a second position. The sheet guide guides cut sheet paper before printing when in the first position and guides fan fold paper after recording when in the second position. The cover also includes an opening for receiving fan fold paper before printing.

The cover may also include eject guides positioned near the ejection portion of both the printer structure and the cover. A paper eject guide guides the ejection of recording material and guides the recording material to an exit through which the paper is ejected.

Accordingly, it is an object of this invention to provide an improved printer case.

Another object of this invention is to provide a printer case in which fan fold paper may be easily positioned within the printer, the printer components may be easily checked for maintenance and paper feeding problems may be easily repaired.

Another object of the invention is to provide a printer case in which the interior components of the printer may be exposed by merely opening the upper portion of the case.

A further object of the invention is to provide a printer case having a cover and a lower case in which the cover can be opened relative to the lower case by applying a small force.

Still other objects and advantages of the invention will in part be obvious and will be apparent from the specification and the drawings.

The invention accordingly comprises the features of construction, combinations of elements, and arrangements of parts which will be exemplified in the construction hereinafter set forth and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1 is a sectional view of a printer constructed in accordance with the prior art;

FIG. 2 is a sectional view of a printer having a printer case constructed in accordance with a preferred embodiment of the present invention;

FIG. 3 is a perspective view of the printer depicted in FIG. 2 having a printer case constructed in accordance with the invention;

DETAILED DESCRIPTION OF THE PREFERRED EMBODIMENT

Figure 4:
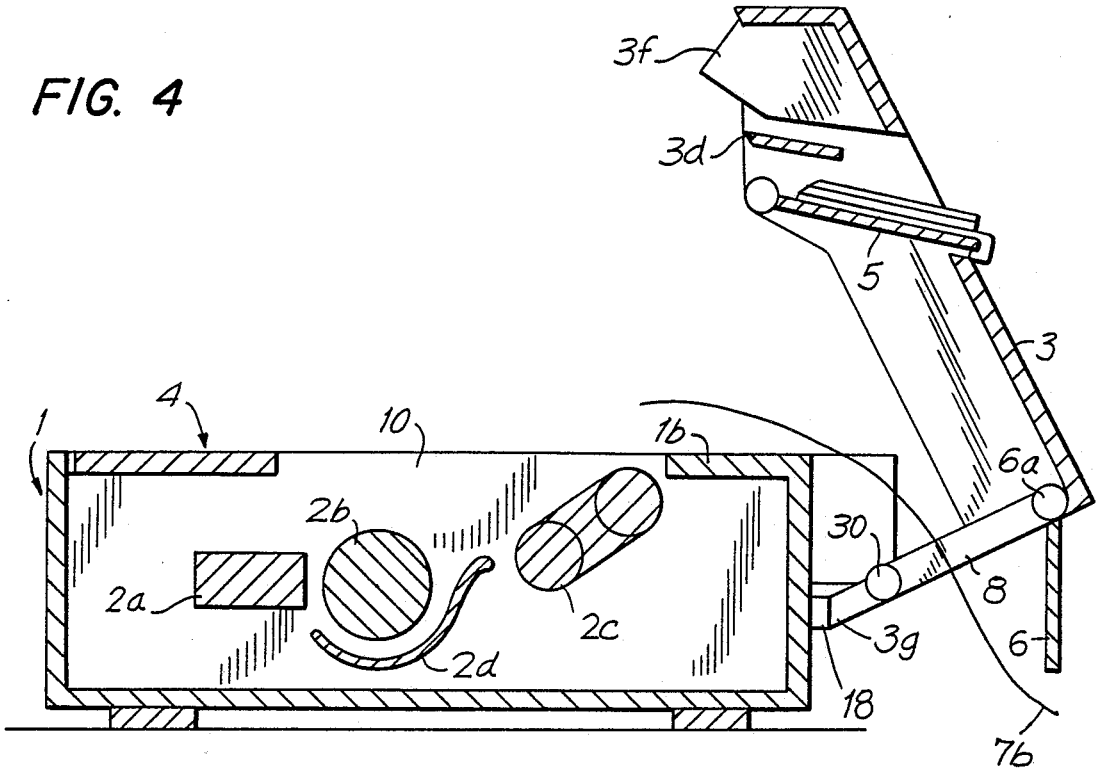
FIG. 4 is a sectional view of the printer case depicted in FIG. 2 which the upper portion of the case is opened.

Reference is first made to FIGS. 2 and 3 in which a printer, generally indicated at 200, having a printer case 4 constructed in accordance with the present invention, is provided. Printer case 4 includes a bottom case or housing, generally indicated at 1, and an upper case or cover, generally indicated at 3. Cover 3 is rotatably coupled to bottom case 1 by a coupling structure 30 described in detail below.

The operative components of printer 200 including print head *2a*, rotatable platen *2b*, push tractor *2c* upstream of platen *2b* and paper guide *2d* are supported within bottom case 1.

Cover 3 includes opposed side walls *3c* separated by a sheet guide member *3e*. A top wall *3b* extends across cover 3 and is formed with an exit opening 9 therein. A plate shaped eject guide plate *3d* is positioned intermediate walls *3c* of cover 3 and is fixedly secured thereto. A plurality of fan shaped paper guides *3f* for guiding paper in and out of cover 3 extend from sheet guide member *3e* and are spaced a predetermined distance defined by a gap *3h* from guide plate *3d*.

Fan shaped paper guides *3f* guide paper 7 after printing towards exit opening 9 to eject the paper. Printed paper 7 passes between fan shaped paper guides *3f* and paper eject guide plate *3d* and is ejected towards exit 9 to eject paper 7.

A sheet guide 5 for guiding individual cut sheets of paper *7a* towards the operative components of printer 200 is pivotably coupled to a mounting axis *5a* which is supported within cover 3. Sheet guide 5 is positioned within exit opening 9. Sheet guide 5 properly guides cut sheet paper into print case 4 for printing. When the printer is to be used with cut sheets of paper, sheet guide 5 is pivoted to the position indicated in phantom at *5b*. Cut sheet *7a* is then properly guided into the printer. Additionally, width control plates *5c* and *5d* are slidably mounted on sheet guide 5 so that they may be slid in the horizontal direction for properly positioning cut sheet *7a*.

Figure 5:
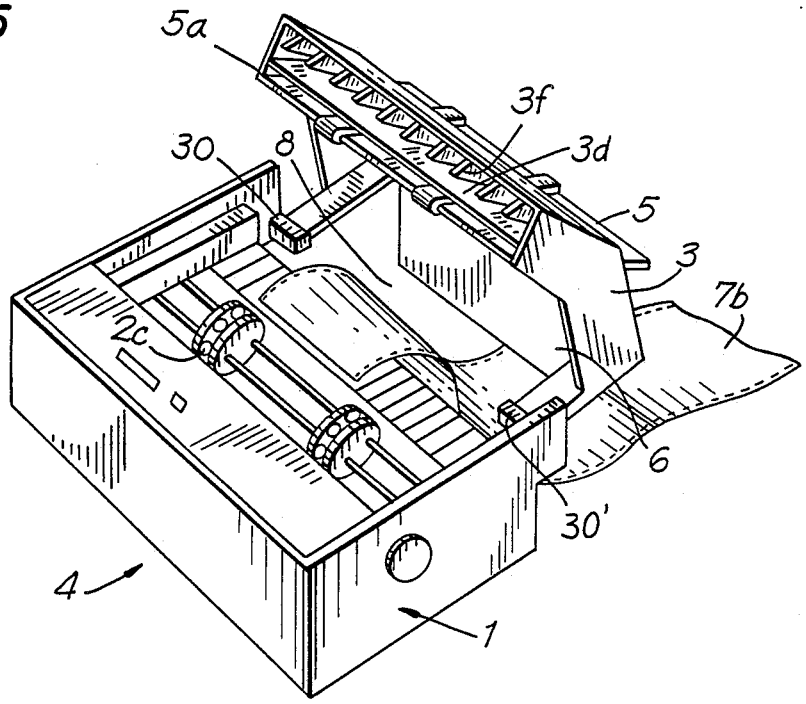
FIG. 5 is a perspective view of the printer case of FIG. 4.

Reference is now also made to FIGS. 4 and 5 in which cover 3 of printer case 4 is pivoted to the open position as depicted to permit insertion of fan fold computer paper *7b*. A second opening 8 is defined in the rear of cover 3 intermediate coupling members 30 and 30'. Since coupling members 30 and 30' are equivalent in structure, only one will be described in detail. A rear cover flap 6 is pivotably secured to cover 3 at a mounting axis *6a* provided proximate the top of opening 8 so that rear cover 6 rotates away from opening 8 as cover 3 is pivoted backwardly. A stopper *3g* is provided on cover 3 below coupling structure 30. When cover 3 is opened wide, stopper *3g* contacts a projection 18 extending from the rear of lower case 1.

When cover 3 is in the open position, fan fold paper *7b* may be inserted and positioned within printer case 4. Specifically cover 3 is opened wide until stopper *3g* mounted on cover 3 contacts projection 18 extending from lower case 1. Because rear cover flap 6 is rotatably mounted on cover 3, it rotates around mounting axis *6a* due to its own weight and hangs downward thus falling away from opening 8 to provide a large opening in the rear of cover 3. Because there is now a large opening 10 above platen *2b*, fan fold paper *7b* may be easily positioned on tractors *2c*, and easily inserted between platen *2b* and paper guide *2d* from the top of lower case 1 allowing easy positioning of fan fold paper *7b*. The setting of fan fold paper *7b* is completed by shutting cover 3.

When the printing process commences, fan fold paper *7b* passes between fan shaped paper guide *3f* and paper eject guide plate *3d* and is ejected through exit opening 9 to eject the paper.

In comparison, when a cut sheet *7a* is used, sheet guide 5 is positioned as shown in phantom at *5b*. When in this condition, cover 3 is closed and cut sheet *7a* is positioned between width control plates *5c* and *5d*. Cut sheet *7a* then travels the same path as fan fold paper *7b*, is printed upon by printing head *2a* and is ejected through exit opening 9.

When problems occur, such as paper jamming, or it becomes necessary to perform internal machine maintenance such as repairing print head *2a*, platen *2b*, push tractor *2c* or paper guide portion *2d*, all that is required is that cover 3 be opened. By opening cover 3 wide, all of the above components become exposed and readily accessible to the printer operator. Therefore, a printer user can easily troubleshoot problems and check the machine components for maintenance thereby making the printer user friendly.

The above invention utilizes a push tractor *2c*, but is just as easily adaptable to printers which utilize pull tractors at a downstream location or both push and pull tractors.

Figure 6:
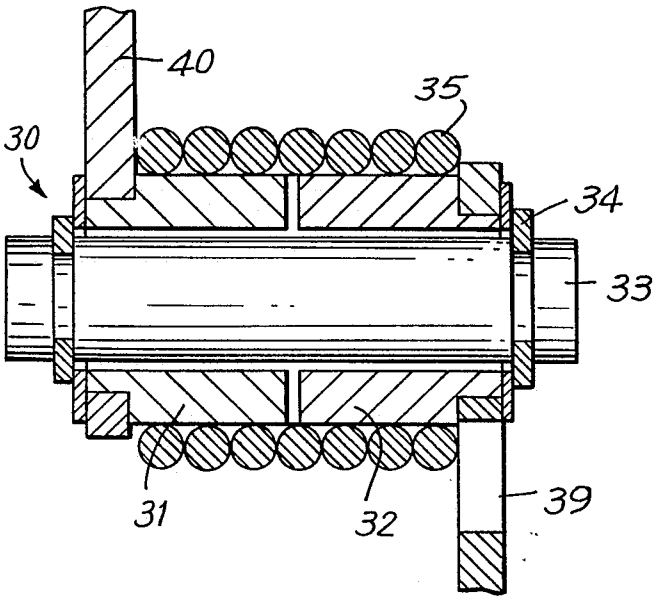
FIG. 6 is a sectional view of a printer case coupling structure constructed in accordance with the present invention.
Figure 7:
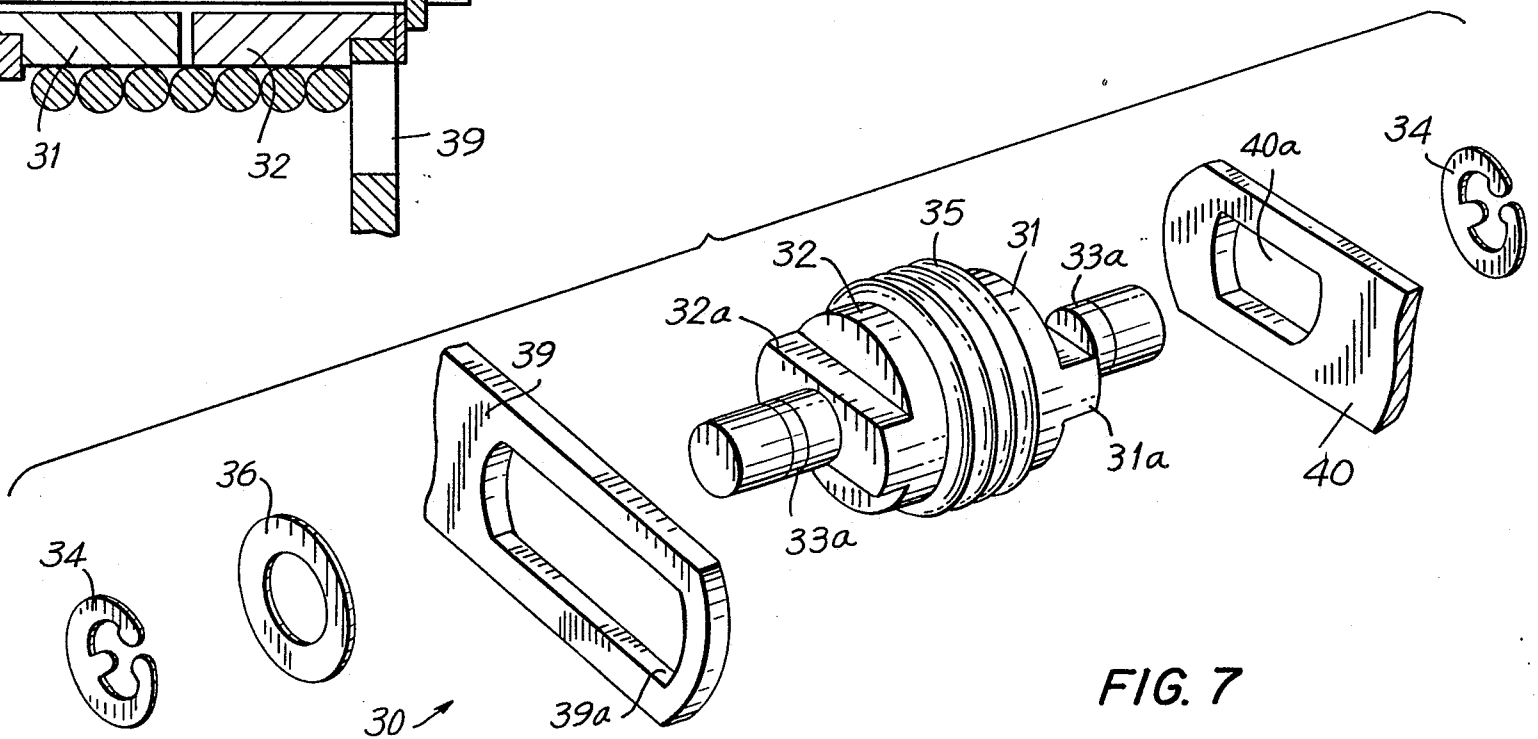
FIG. 7 is an exploded view showing several components of a coupling structure constructed in accordance with the invention.

Reference is now made to FIGS. 6 and 7 wherein the axis component for coupling structure 30, constructed in accordance with the invention, is depicted. Coupling structure 30 includes a main axis 33. A bearing 31 and a bearing 32 are rotatably mounted about main axis 33. A metallic coil spring 35 is wound about main axis 33 so that it is fastened to the circumference of bearing 31 and bearing 32. Coil spring 35 is wound in a single direction so that friction is generated in only one direction by coil spring 35. Therefore, when bearing 31 is fixed and bearing 32 is allowed to rotate in a first direction, bearing 32 is rotated in an almost frictionless manner. When the direction of rotation is reversed, friction is generated.

By mounting bearing 32 on bottom case 1 or cover 3, cover 3 may be smoothly opened utilizing only a small force. Conversely, by applying the appropriate force to cover 3, cover 3 can then be shut.

As can be better seen in FIG. 7, bearings 31 and 32 have D-shaped cuts *31a* and *32a* at their respective ends to facilitate fitting a fixed arm 40 and a movable arm 39. Fixed arm 40 is mounted to cover 3. D-shaped cut *32a* fits within D-shaped opening *39a* of movable arm 39 and D-shaped cut *31a* fits within D-shaped cut *40a* of fixed arm 40. Main axis 33 is provided with grooves, *33a* at either end thereof. Grooves *33a* are for receiving E-shaped stopper rings 34 provided at both ends of main axis 33 to prevent main axis 33 from slipping through fixed arm 40 or movable arm 39. A spacer 36 is provided between E-shaped stopper 34 and movable arm 39. This structure makes up the axis of coupling structure 30.

Figure 8:
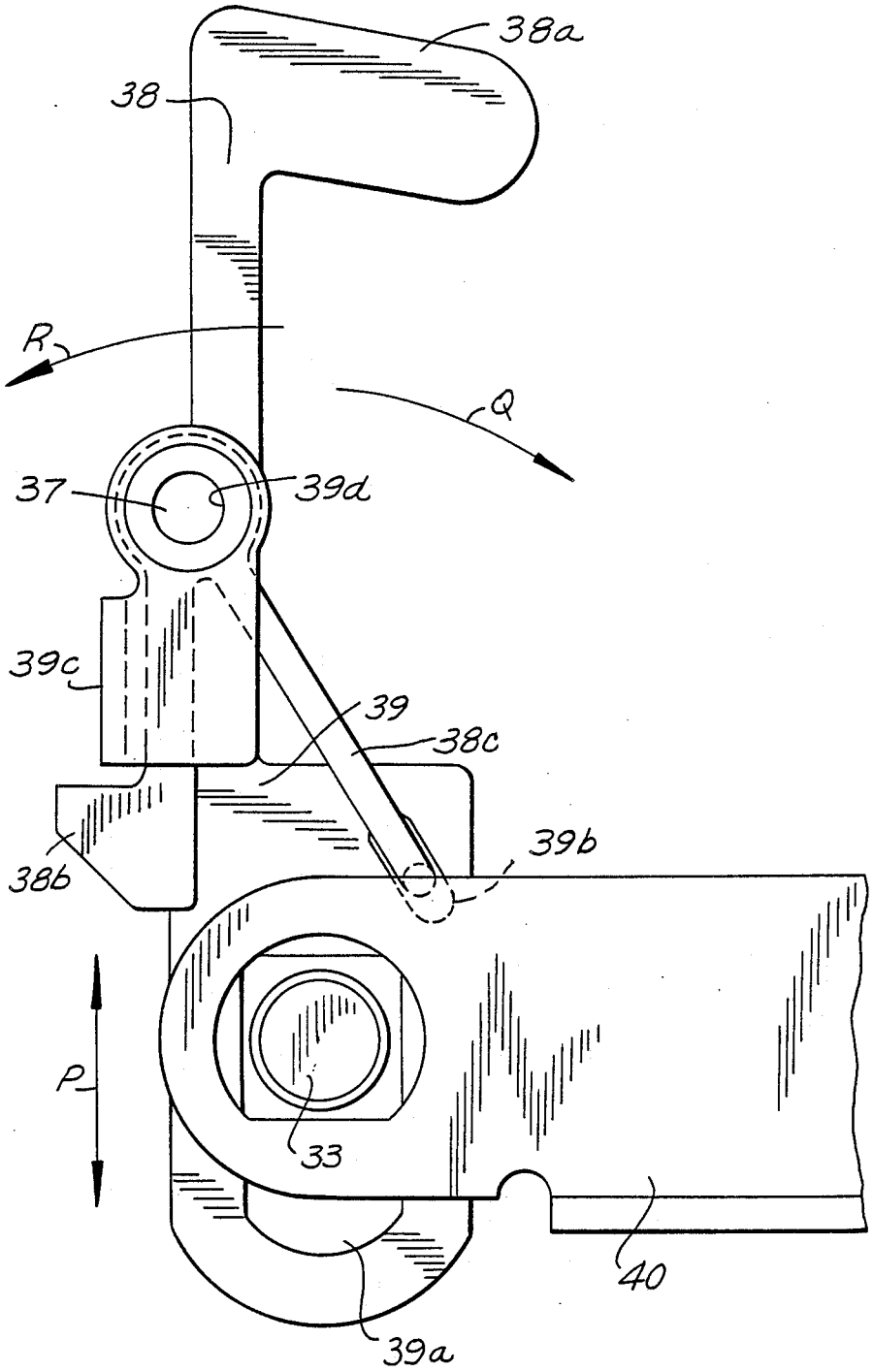
FIG. 8 is a side elevational view of the coupling structure constructed in accordance with the invention.
Figure 9:
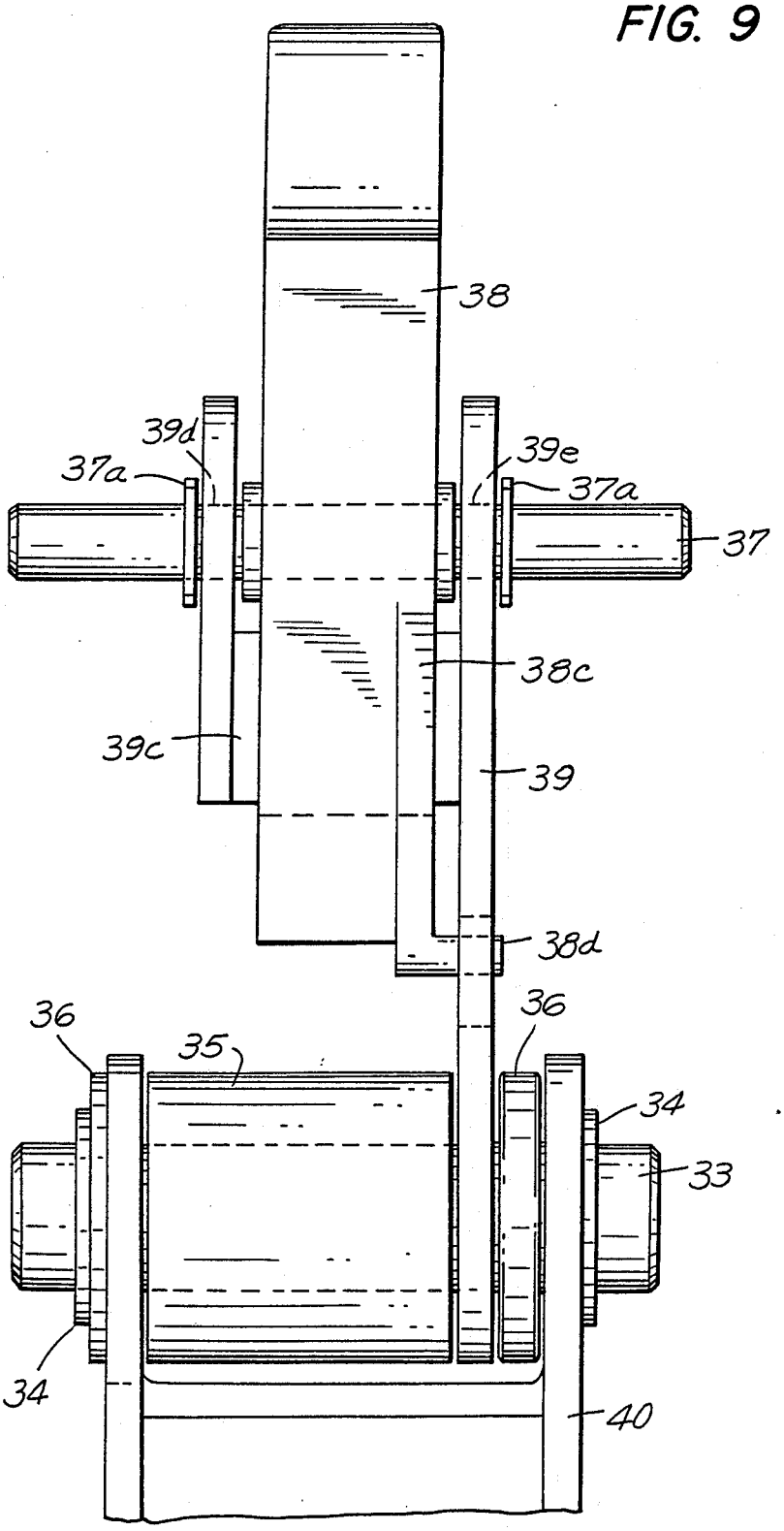
FIG. 9 is a rear elevational view of the coupling structure constructed in accordance with the invention.

Reference is now made to FIGS. 8 and 9 in which a detailed view of coupling structure 30 is provided. A rectangular or D-shaped opening *39a* is provided in movable arm 39 so that cut portion *32a* of bearing 32 may be inserted into rectangular opening *39a*. The length of rectangular opening 39 is primarily provided in the vertical direction of bearing 32. Movable arm 39 is also provided with openings *39d* and *39e*. A lock lever 38 is rotatably mounted between openings *39d* and *39a* about a lock lever stopping axis 37 which extends through openings *39d* and *39e*. Lock lever 38 is covered by a bent portion of movable arm 39.

Lock lever stopping axis 37, preferably made of a synthetic resin, supports lock lever 38. Lock lever 38 includes a handle 38*a* and an elastic spring portion 38*c* for supplying a restoring force when lock lever 38 is rotated counterclockwise in the direction of arrow R. A projection 38*d* formed at the end of elastic spring 38*c* engages with rectangular opening 39*b* of movable arm 39. A stopper or engaging portion 38*b* is formed in a nail shape at the rear of lock lever 38.

Lock lever stopping axis 37 is provided with E-shaped stops 37*a* at either end to prevent displacement in a lateral direction through openings 39*e* and 39*d*. Therefore, movable arm 39 can be slid in the direction of arrow P. When removable arm 39 is rotated about axis 33 in the rotational direction of arrow Q with respect to fixed arm 40, friction is generated.

Figure 10:
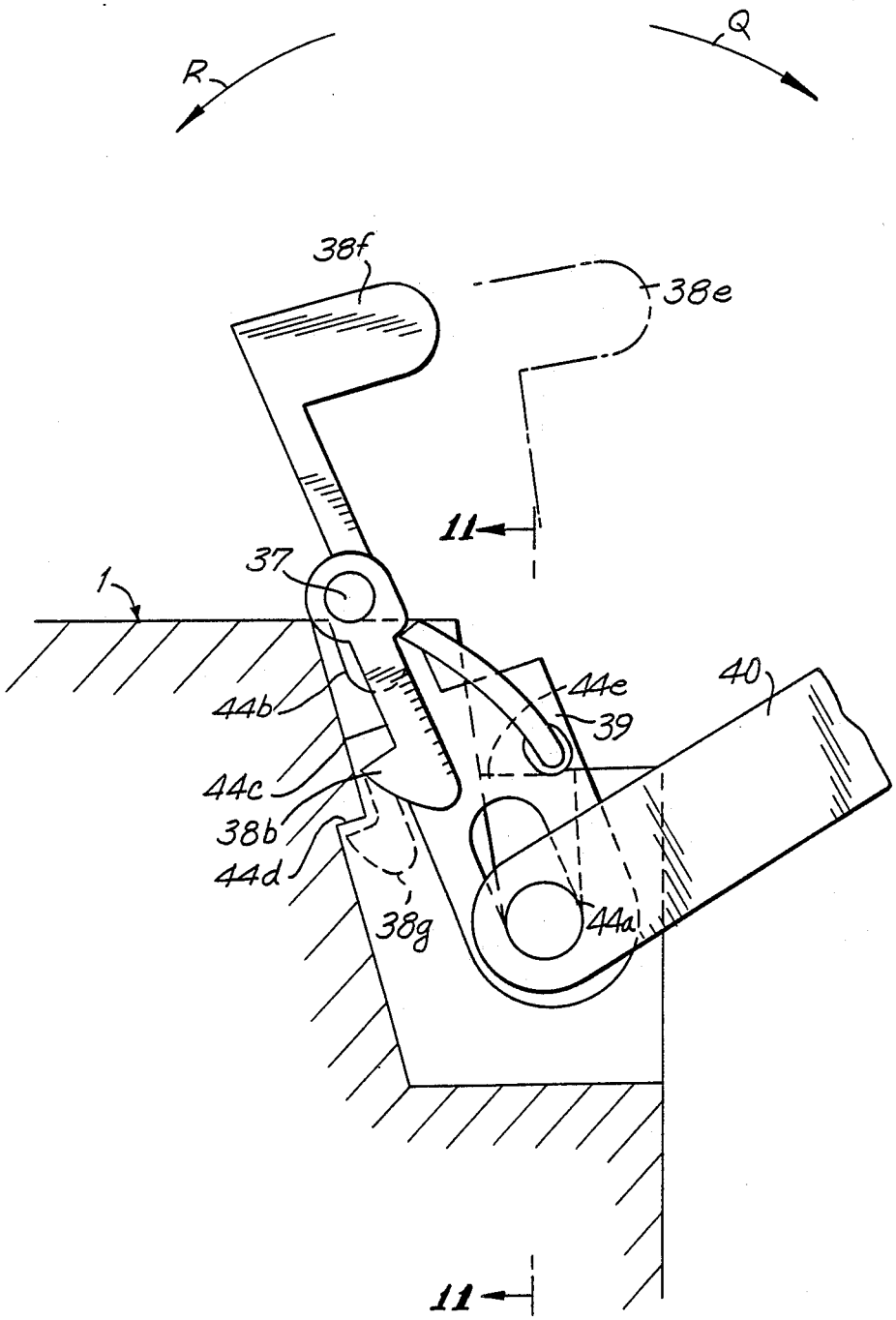
FIG. 10 is a sectional view of the coupling structure illustrating the locking feature of the coupling mechanism.
Figure 11:
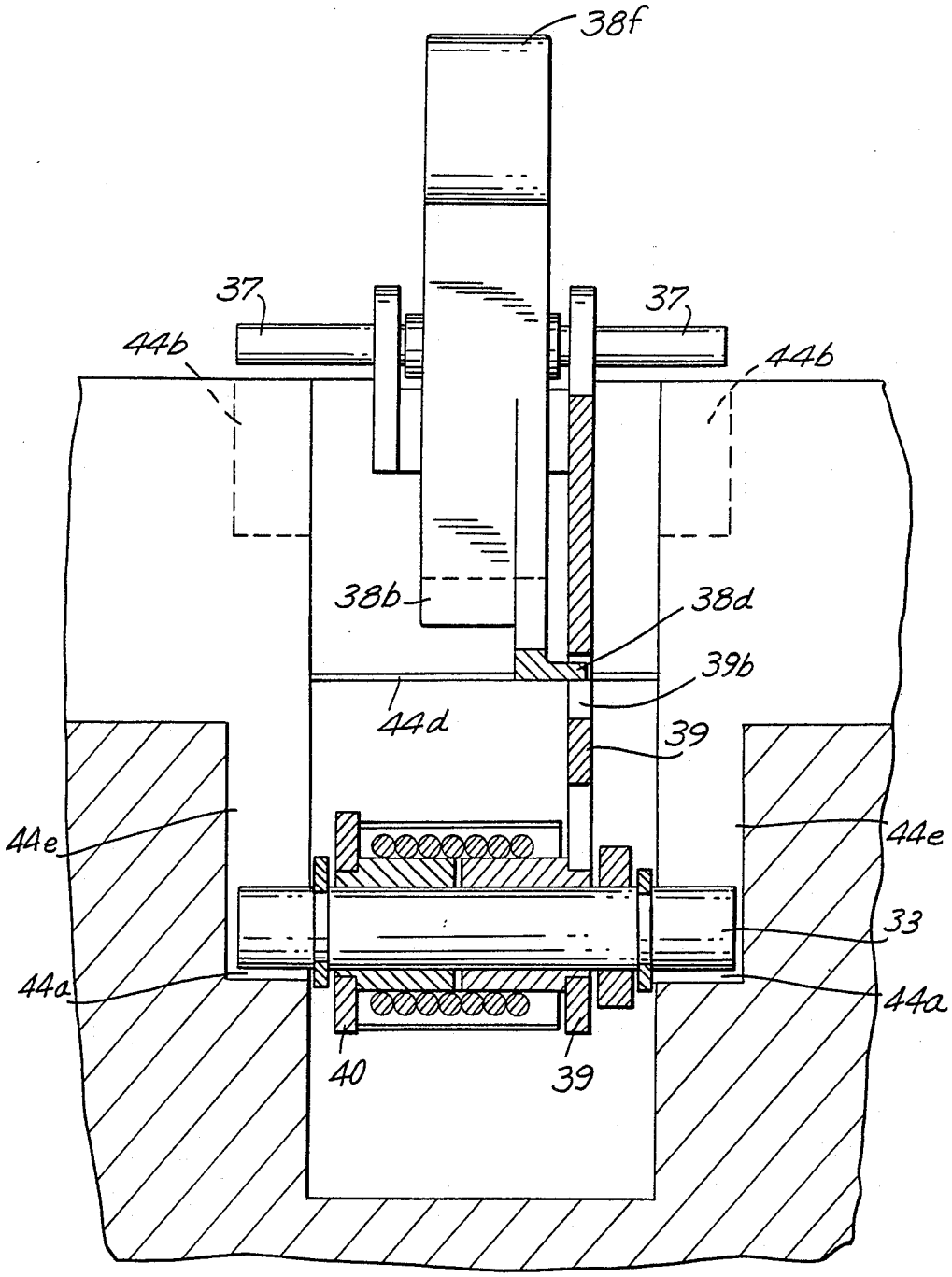
FIG. 11 is an enlarged sectional view taken along line 11—11 of FIG. 10.

Reference is now made to FIGS. 10 and 11 to explain the operation of lock lever 38. The bearing portion of bottom case 1 includes a groove forming a main axis guide 44*e* for supporting both ends of main axis 33 and lock lever guiding groove 44*b* which allows sliding of both ends of lock lever stopping axis 37 in a substantially vertical direction and limits movement in the horizontal direction. A lock lever stopping portion 44*d* of bottom case 1 engages with engaging portion 38*b* of lock lever 38 when lock lever 38 is depressed.

To position cover 3 relative to bottom case I, first, main axis 33 of coupling structure 30 mounted on cover 3 is placed into main axis guide 44*e* from above and is positioned within main bearing 44*a*. By pulling up lock lever 38, lock lever 38 may be rotated in the direction of arrow R until contact surface 39*c* of movable arm 39 comes in contact with a contact surface 44*c* of the case. When lock lever 38 is rotated in the direction of arrow R, no friction is generated. In this condition, elastic spring 38*c* of lock lever 38 becomes warped and biases engaging portion 38*d* of lock lever 38 generally in the direction of arrow R.

Lock lever 38 is then depressed along the contact surface 44*c* of bottom case 1 so that engaging portion 38*b* of lock lever 38 engages engaging portion 44*d* of bottom case 1 as indicate by the dotted line 38*g* of FIG. 10. Because of the restoring force of elastic spring 38*c*, lock lever 38 is locked by the case. Simultaneously, both ends of lock lever stopping axis 37 become inserted into lock lever guiding groove 44*b* controlling movement of lock lever stopping axis 37 in the horizontal direction. The direction of the long axis of rectangular opening 39*a* of movable arm 39 is now parallel to contact surface 44*c* formed by case 1 and lock lever guiding groove 44*b*. The guide length of lever guiding groove 44*b* is shorter than the slide distance of lock lever engaging portion 38*b*.

When movable arm 39 is depressed, stop axis 37 engages lock lever guide 44*b*. When movable arm 39 is pulled up, disengagement occurs and lock lever 38 is released.

When lock lever 38 is locked with bottom case 1, cover 3 can be opened by a weak force due to the small friction. When fixed arm 40 is rotated in the direction of arrow R, i.e. when cover 3 is closed, friction is generated, thereby preventing the heavy case from suddenly being opened due to a shock. Additionally, in this situation, if cover 3 is pulled up, cover 3 does not fall off because lock lever 38 engages case body 1.

To disengage coupling structure 30, fixed arm 40 and along with it cover 3, are rotated in the direction of arrow Q. Handle 38*a* is rotated from the position shown in phantom at 38*e* in a direction of arrow R to the position shown at 38*f* and is then pulled up. Stopper 38*b* then disengages from lock lever engaging portion 44*d* and lock lever stop axis follows, freeing itself from lock lever guiding groove 44*b*. Cover 3 and the coupling unit are pulled up so that main axis 33 is removed from main axis guide 44*e*. Cover 3 is now disengaged from bottom case 1.

By providing a printer case including a bottom case section and an upper cover which is pivotably coupled to the bottom case section, the cover including a sheet guide rotatably mounted within the cover having paper ejection guides, and an opening in the back of the unit that allows fan fold paper to pass through before printing, the cover may be opened to allow easy access to the internal components of the printer for troubleshooting or maintenance of the printer. When the cover is closed relative to the lower case, cut sheet paper may be utilized in printing. When the cover is in the open position fan fold paper may be inserted for use in printing.

By coupling the bottom case to the cover through a coupling structure which causes friction if the cover is rotated in one direction causing the cover to shut and is relatively frictionless when rotated in the second or reverse direction, a printer case in which the cover may be opened by a weak force is provided. Additionally, the cover will not shut by accident due to its own weight or from impact. By providing a coupling means which is fixed to the cover and selectively engages an engaging portion of the lower case, the cover can be easily removed from the bottom case.

It will thus be seen that the objects set forth above, among those made apparent from the preceding description, are efficiently attained and since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which as a matter of language might be said to fall therebetween.

What is claimed is:

1. A printer case for a printer having printer components adapted to print on individual sheets of paper and fan-fold computer paper, comprising a bottom case supporting said printer components therein, a cover having a sheet guide pivotably supported thereon, said sheet guide being pivotable between a first position for guiding individual sheets into said printer and a second position for guiding fan-fold paper out of said printer after printing has occurred thereon, and coupling means for pivotably coupling said cover to said bottom case between a first position where said cover is closed to permit printing to occur and a second position where said cover is open to expose said printer components and to permit insertion of said fan-fold paper, said cover being formed with a rear opening and further comprising a mounting axis mounted within said opening and a rear cover flap rotatably supported about said mounting axis to close said rear opening when said cover is closed.

2. The printer case as claimed in claim 1, wherein said cover includes an exit opening through which cut sheets and fan-fold paper is ejected and paper eject guide means supported on said cover proximate said exit opening for guiding said cut sheets and computer fan-fold paper to said ejection opening.

3. The printer case as claimed in claim 2, wherein said cover includes an entrance opening through which fan-fold paper can be inserted when said cover is open to permit loading of fan-fold paper in said printer.

4. The printer case as claimed in claim 1, wherein said cover includes an entrance opening through which fan-fold paper can be inserted when said cover is open to permit loading of fan-fold paper in said printer.

5. The printer case as claimed in claim 1, wherein said cover is removably coupled to said bottom case.

6. The printer case as claimed in claim 1, wherein said coupling means creates a predetermined force opposed to the closing of said cover to permit safe closing of said case.

7. The printer case as claimed in claim 1, wherein said printer components include a platen, tractor and paper guide, each being supported within said bottom case and exposed when said cover is open.

8. The printer case as claimed in claim 1, wherein said cover includes an exit opening through which paper is ejected and further including a plurality of fan shaped paper guides for guiding printed paper toward said exit opening.

9. The printer case as claimed in claim 1, wherein said coupling means includes a first portion fixed to said cover and a second portion removably coupled to said bottom case.

10. A printer case for a printer having printer components adapted to print on individual sheets of paper and fan-fold computer paper, comprising a bottom case supporting said printer components therein, a cover having a sheet guide pivotably supported thereon, said sheet guide being pivotable between a first position for guiding individual sheets into said printer and a second position for guiding fan-fold paper out of said printer after printing has occurred thereon, and coupling means for pivotably coupling said cover to said bottom case between a first position where said cover is closed to permit printing to occur and a second position where said cover is open to expose said printer components and to permit insertion of said fan-fold paper, said coupling means including a main axis, a first bearing rotatably coupled about said main axis, a second bearing rotatably coupled about said main axis and a coil spring wound about said main axis and coupled to the circumference of said first bearing and said second bearing, friction being generated in only one direction of rotation by the coil spring when said cover is closed.

11. The printer case as claimed in claim 10, further comprising a fixed arm mounted on said cover and a movable arm, said main axis extending through and engaging both said movable arm and said fixed arm.

12. The printer case as claimed in claim 11, wherein said bottom case includes an engaging portion, said coupling means being mounted to said cover, said coupling means including engaging means for engaging with said engaging portion formed on said bottom case.

13. The printer case as claimed in claim 12, wherein said engaging means includes a lock lever rotatably mounted between said movable arm and said fixed arm.

14. The printer case as claimed in claim 13, wherein said lock lever includes a handle, an elastic portion and an engaging portion.

15. The printer case as claimed in claim 12, wherein said engaging means further includes a lever stopping axis, said lock lever being rotatably mounted about said lever stopping axis.

16. The printer case as claimed in claim 15, wherein said bottom case includes main axis guide means for supporting both ends of said main axis and lock lever guide means for allowing both ends of said lock lever stopping axis to slide in a substantially vertical direction and limit movement in a horizontal direction.

17. The printer case as claimed in claim 16, wherein said bottom case is formed with a lock lever stopping portion for engaging with said lock lever engaging portion.

* * * * *